US009368906B2

(12) United States Patent
Endo et al.

(10) Patent No.: US 9,368,906 B2
(45) Date of Patent: Jun. 14, 2016

(54) ELECTRIC TERMINAL

(71) Applicant: DAI-ICHI SEIKO CO., LTD., Kyoto (JP)

(72) Inventors: Takayoshi Endo, Shizuoka (JP); Kenya Ando, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/717,810

(22) Filed: May 20, 2015

(65) Prior Publication Data

US 2015/0364857 A1 Dec. 17, 2015

(30) Foreign Application Priority Data

Jun. 12, 2014 (JP) ..... 2014-121698

(51) Int. Cl.

| | |
|---|---|
| ***H01R 13/52*** | (2006.01) |
| ***H01R 13/05*** | (2006.01) |
| ***H01R 13/22*** | (2006.01) |
| ***H01R 13/424*** | (2006.01) |
| ***H01R 13/11*** | (2006.01) |
| ***H01R 13/428*** | (2006.01) |

(52) U.S. Cl.

CPC ..... *H01R 13/5219* (2013.01); *H01R 13/05* (2013.01); *H01R 13/11* (2013.01); *H01R 13/22* (2013.01); *H01R 13/424* (2013.01); *H01R 13/428* (2013.01)

(58) Field of Classification Search

CPC .... H01R 13/5219; H01R 13/05; H01R 13/11; H01R 13/424; H01R 13/428

USPC ..... 439/752.5, 851, 852, 733.1, 589, 587, 439/274

See application file for complete search history.

(56) References Cited

U.S. PATENT DOCUMENTS

| | | | | |
|---|---|---|---|---|
| 4,963,102 | A * | 10/1990 | Gettig | H01R 13/28 439/291 |
| 5,378,170 | A * | 1/1995 | Abe | H01R 13/4223 439/374 |
| 5,556,304 | A * | 9/1996 | Jinno | H01R 13/4223 439/595 |
| 5,676,572 | A * | 10/1997 | Endo | H01R 13/187 439/845 |
| 5,997,362 | A * | 12/1999 | Hatagishi | H01R 13/42 439/701 |
| 6,068,524 | A * | 5/2000 | Koumatsu | H01R 13/642 439/752.5 |
| 6,146,215 | A * | 11/2000 | Matsushita | H01R 13/113 439/752 |
| 6,227,915 | B1 * | 5/2001 | Sakatani | H01R 13/11 439/752.5 |

(Continued)

FOREIGN PATENT DOCUMENTS

| | | | |
|---|---|---|---|
| JP | S55044513 | 3/1980 | H01R 23/70 |
| JP | S56056178 | 5/1981 | H01R 13/11 |

(Continued)

*Primary Examiner* — Abdullah Riyami
*Assistant Examiner* — Nelson R Burgos-Guntin
(74) *Attorney, Agent, or Firm* — Hayes Soloway P.C.

(57) ABSTRACT

A terminal to be inserted into a storage space formed in a housing includes a hollow sheath portion, and a first engagement portion to be engaged with the storage space, the first engagement portion including a first inclining portion, and a first abutment portion extending from an upper end of the first inclining portion towards the sheath portion and making abutment at a lower end thereof with a ceiling of the sheath portion, the terminal being formed of a single metal sheet, the first engagement portion being formed by bending a projecting part around a direction intersecting with the axis of the sheath portion, the projecting part being a part of the metal sheet defining the sheath portion and extending in parallel with a direction in which the terminal is inserted into the housing.

10 Claims, 16 Drawing Sheets

(56) References Cited

U.S. PATENT DOCUMENTS

| | | | | |
|---|---|---|---|---|
| 6,254,430 | B1 * | 7/2001 | Endo | H01R 9/05 439/438 |
| 6,336,979 | B1 * | 1/2002 | Sugawara | C22F 1/02 148/282 |
| 6,364,692 | B1 * | 4/2002 | Okayasu | H01R 13/5219 439/204 |
| 2004/0192119 | A1 * | 9/2004 | Sakurai | H01R 13/64 439/752.5 |
| 2005/0227551 | A1 * | 10/2005 | Tabata | H01R 13/113 439/852 |
| 2014/0170885 | A1 * | 6/2014 | Endo | H01R 13/506 439/345 |
| 2014/0342606 | A1 * | 11/2014 | Endo | H01R 13/4223 439/595 |
| 2015/0056872 | A1 * | 2/2015 | Endo | H01R 13/213 439/733.1 |
| 2015/0263456 | A1 * | 9/2015 | Hashimoto | H01R 13/113 439/752.5 |
| 2015/0364857 | A1 * | 12/2015 | Endo | H01R 13/05 439/733.1 |

FOREIGN PATENT DOCUMENTS

| | | | |
|---|---|---|---|
| JP | H10247542 | 9/1998 | H01R 13/42 |
| JP | 11-224709 | 8/1999 | H01R 13/11 |
| JP | 2001-143807 | 5/2001 | H01R 13/42 |
| JP | 2002198118 | 7/2002 | H01R 13/11 |
| JP | 2003-331972 | 11/2003 | H01R 13/42 |
| JP | 2005302573 | 10/2005 | H01R 13/11 |

* cited by examiner

ELECTRIC TERMINAL

BACKGROUND OF THE INVENTION

1. Field of the Invention

The invention relates to an electric terminal to be used for a water-proof connector including a water-proof mat seal, used as an electric connector between various devices to be equipped in, for instance, an automobile.

2. Description of the Related Art

Japanese Patent Application Publication No. 2002-198118 suggests an example of a water-proof connector including a water-proof mat seal and an electric terminal to be inserted thereinto.

FIG. 18 is a broken cross-sectional view of the water-proof connector and the electric terminal both suggested in the above-identified Publication, and FIG. 19 is a front view of the terminal.

A terminal 70 is fabricated by pressing a metal sheet. As illustrated in FIGS. 18 and 19, the terminal 70 includes a body 71 in the form of a box, and a barrel portion 72 onto which a wire W is compressed and fixed at an end thereof. The body 71 is open at a front thereof such that a second terminal (not illustrated) is inserted thereinto for electrically connecting with the terminal 70. The body 71 includes at a side edge on a lower surface a pair of stabilizers 73*a* and 73*b* spaced away from each other and extending downwardly.

The stabilizers 73*a* and 73*b* are formed by binding a metal sheet, and are in the form of a flat sheet having a thickness twice greater than that of the metal sheet. The front stabilizer 73*a* has a front edge 75*a* aligning with a front edge of the body 71, and tapered in a length-wise direction of the body 71. The rear stabilizer 73*b* is situated in the vicinity of a center in a length-wise direction of the body 71, and has a rear edge 75*b* tapered in a length-wise direction of the body 71.

A recess 77 is defined between the stabilizers 73*a* and 73*b*. As mentioned later, a housing 80 is formed with a lance 95 having an engagement portion 92. The engagement portion 92 is engaged with the recess 77 when the terminal 70 is inserted into the housing 80.

When the terminal 70 is inserted into a cavity 81 formed in the housing 80, the stabilizers 73*a* and 73*b* are fit into guide grooves 82 and 85 to thereby introduce the terminal 70 into the cavity 81.

The housing 80 made of synthetic resin is formed therein with a plurality of cavities 81 into each of which the terminal 70 is inserted. Each of the cavities 81 includes at side edges on an inner lower surface thereof guide grooves 82 into which the stabilizers 73*a* and 73*b* of the terminal 70 can be fit.

The cavities 81 are partitioned by a partition wall 83 in the form of a matrix. The housing 80 includes a front wall 84 facing a front end of the cavities 81. The front wall 84 is formed with an opening 90 through which a male terminal (not illustrated) can be inserted into the cavity 81 for electrically connecting with the terminal 70 having been already inserted into the cavity 81.

The housing 80 includes at a rear thereof a hole 87 leading to all of the cavities 81. A rubber cap 88 is fit into the hole 87 at a bottom of the hole 87. The rubber cap 88 is designed to have a predetermined thickness, and a substantially rectangular cross-section to allow the rubber cap 88 to be tightly fit into the hole 87.

The rubber cap 88 includes at a circumferential surface thereof external lips 89, and further a plurality of holes 91 each aligning with each of the cavities 81 of the housing 80. Each of the holes 91 includes at an inner surface thereof internal lips 91*a* deformable on making contact with an outer surface of the wire W to thereby make close contact with the outer surface of the wire W.

The rubber cap 88 is fixed in the hole 87 by a cover 93 inserted into the hole 87 to compress the rubber cap 88. The cover 93 is made of synthetic resin, and has such a cross-section that the cover 93 can be tightly fit into the hole 87. The cover 93 is formed with a plurality of windows 94 in a matrix each aligning with each of the cavities 81 of the housing 80 and each of the holes 91 of the rubber cap 88 to allow the terminal 70 to be inserted into the cavity 81 through the windows 94 and the holes 91.

Each of the windows 94 includes at side edges on an inner lower surface thereof guide grooves 85 into which the stabilizers 73*a* and 73*b* of the terminal 70 can be fit. The guide grooves 82 of the housing 80 and the guide grooves 85 of the cover 93 align with each other in a direction in which the terminal 70 is inserted into the cavity 81.

The cover 93 includes a pair of arms 96 outwardly extending from upper and lower ends of the cover 93. Protrusions 86 standing on an outer surface of the housing 80 are fit into recesses 96*a* formed at inner surfaces of the arms 96, thus the cover 93 is fixed to the housing 80 to thereby prevent the rubber cap 88 from being released out of the housing 80.

As illustrated in FIG. 18, the terminal 70 having been inserted into the cavity 81 in the housing 80 is kept engaged in the cavity 80, since the engagement portion 92 extending from the lance 95 formed in the cavity 81 is elastically engaged with the recess 77. The stabilizers 73*a* and 73*b* extend in a direction perpendicular to a direction in which the terminal 70 is inserted into the cavity 81 are fit into the guide groove 82 formed at an inner surface of the cavity 81 to thereby guide the terminal 70 to be inserted into the cavity 81.

As illustrated in FIGS. 18 and 19, the terminal 70 includes the stabilizers 73*a* and 73*b* formed by bending a sidewall of the terminal 70 to inside from outside. The stabilizers 73*a* and 73*b* have a function of engagement with the lance 95 formed in the cavity 81.

When the terminal 70 is inserted into the cavity 81 or pulled out of the cavity 81, rough surfaces of the stabilizers 73*a* and 73*b* may interfere with an inner surface of the hole 91 of the rubber cap 88 to thereby damage the rubber cap 88. Herein, "rough surfaces" mean surfaces of the stabilizers 73*a* and 73*b* at which an electrically conductive metal sheet is cut or punched into a shape of the terminal 70.

SUMMARY OF THE INVENTION

In view of the above-mentioned problems in the conventional terminal, it is an object of the present invention to provide a terminal being able to be readily inserted into a housing of a water-proof connector, being unlikely to damage a rubber cap when the terminal is inserted into the housing, and further, being difficult to be deformed even by an external force acting thereon in a direction in which the terminal is inserted into or pulled out of the housing.

In one aspect of the present invention, there is provided a terminal to be inserted into a storage space formed in a housing, the terminal including a hollow sheath portion, and a first engagement portion to be engaged with a lance formed within the storage space, the first engagement portion extending outwardly from the sheath portion, the first engagement portion including a first inclining portion having such an inclination angle that a part thereof located closer to one of opposite ends of the terminal is remoter from an axis of the sheath portion, and a first abutment portion extending from an upper end of the first inclining portion towards the axis of the sheath portion, and making abutment at a lower end thereof with a ceiling of the sheath portion, the terminal being formed of a single metal sheet, the first engagement portion being formed by bending a projecting part around a direction intersecting with the axis of the sheath portion, the projecting part being a part of the metal sheet defining the sheath portion, and extending in parallel with a direction in which the terminal is inserted into the housing.

The terminal in accordance with the present invention is designed to include the first engagement portion including the first inclining portion having such an inclination angle that a part thereof located closer to the one of the opposite ends of the terminal is remoter from the axis of the sheath portion. Thus, when the terminal is inserted into the storage space formed in the housing of the water-proof connector, the first inclining portion acts as a wedge to ensure that the terminal can be readily inserted into the housing, and further that the terminal does not damage a rubber cap when the terminal is inserted into the housing.

The first engagement portion includes the above-mentioned first inclining portion, and the first abutment portion extending from the upper end of the first inclining portion towards the axis of the sheath portion, and making abutment at the lower end thereof with the ceiling of the sheath portion. The first engagement portion is formed by bending the projecting part around the direction intersecting with the axis of the sheath portion, the projecting part being a part of the metal sheet defining the sheath portion, and extending in parallel with the direction in which the terminal is inserted into the housing. Thus, the sheath portion and the first engagement portion are integral with each other to thereby have an increased rigidity, and accordingly, the first engagement portion is quite difficult to be deformed even if an external force acts on the terminal inserted into the storage space in the housing, in a direction in which the terminal is inserted into or released out of the housing.

It is preferable that the terminal further include a first reinforcement for preventing the first engagement portion from being displaced and/or deformed due to an external force acting thereon in parallel with the direction in which the terminal is inserted into the housing, the first reinforcement being situated to make contact with the lower end of the first abutment portion.

It is preferable that the terminal further include a second reinforcement for preventing the first engagement portion from being displaced and/or deformed due to an external force acting thereon in parallel with the direction in which the terminal is inserted into the housing, the second reinforcement sandwiching the first abutment portion at the lower end thereof together with the first reinforcement.

It is preferable that the terminal further include a second engagement portion located remotely from the first engagement portion in a length-wise direction of the terminal, the second engagement portion extending outwardly from the sheath portion, the second engagement portion including a second inclining portion having such an inclination angle that a part thereof located closer to the one of the opposite ends of the terminal is closer to the axis of the sheath portion, and a second abutment portion extending from an upper end of the second inclining portion towards the axis of the sheath portion, and making abutment at a lower end thereof with the ceiling of the sheath portion, the second engagement portion being formed by bending a projecting part around a direction intersecting with the axis of the sheath portion, the projecting part being a part of the metal sheet defining the sheath portion, and extending in parallel with the direction in which the terminal is inserted into the housing.

It is preferable that the first reinforcement be formed by bending a first projecting part around a direction in parallel with the axis of the sheath portion, the first projecting part being a part of the metal sheet defining the sheath portion, and extending in a direction intersecting with the axis of the sheath portion.

It is preferable that the second reinforcement be formed by bending a second projecting part around a direction in parallel with the axis of the sheath portion, the second projecting part being a part of the metal sheet defining the sheath portion, and extending in a direction intersecting with the axis of the sheath portion.

It is preferable that the first reinforcement be in the form of a flat metal sheet making plane-contact with an outer surface of the sheath portion.

It is preferable that the second reinforcement be in the form of a flat sheet making plane-contact with an outer surface of the sheath portion.

The advantages obtained by the aforementioned present invention will be described hereinbelow.

The terminal in accordance with the present invention can be readily inserted into the housing of the water-proof connector, prevent the rubber cap from being damaged when the terminal is inserted into the housing, and is difficult to be deformed even if an external force acts thereon in a direction in which the terminal is inserted into and pulled out of the housing, after the terminals inserted into the housing.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
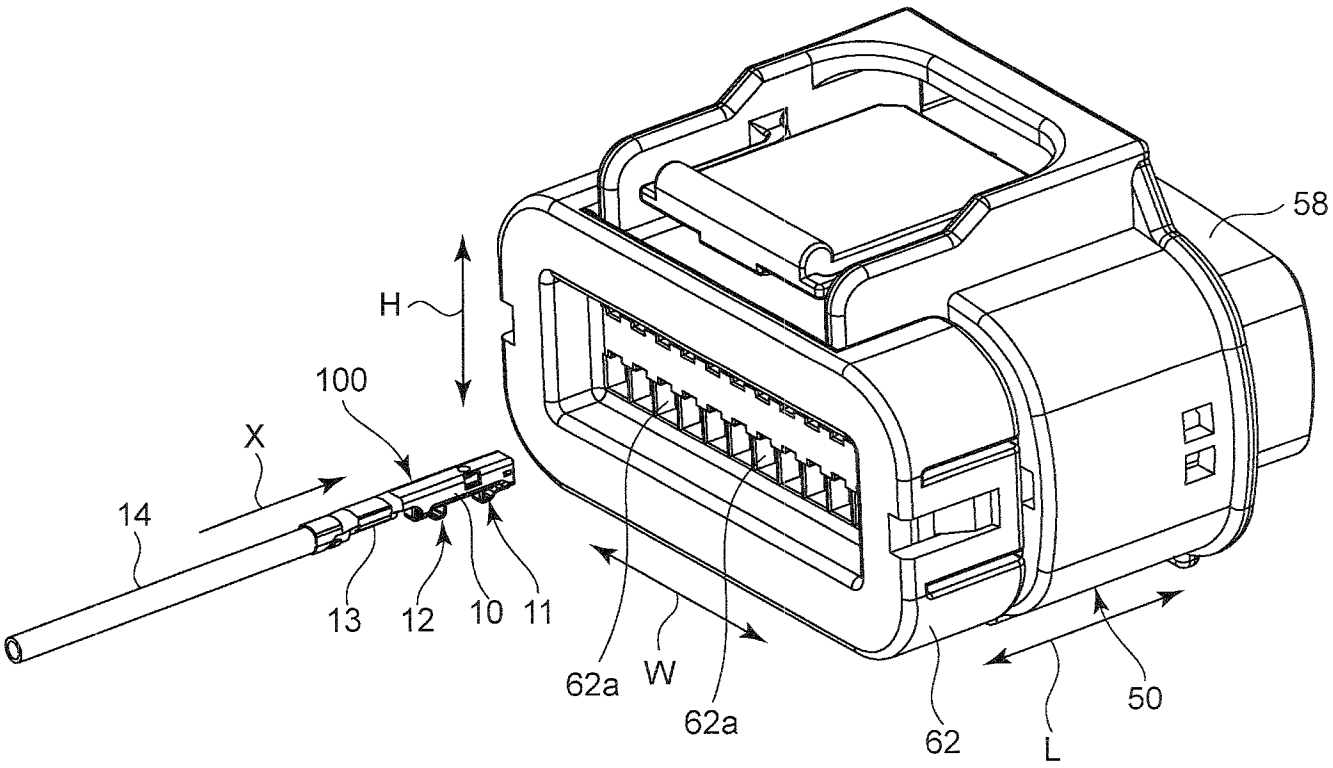
FIG. 1 is a perspective view illustrating that a terminal in accordance with a preferred embodiment of the present invention is inserted into a housing.

A terminal 100 in accordance with a preferred embodiment of the present invention will be explained hereinbelow with reference to FIGS. 1 to 17.

The terminal 100 is made from a single metal sheet. Specifically, the terminal 100 can be formed by steps of punching an electrically conductive metal sheet 99 into a predetermined shape, and bending the thus punched metal sheet 99 (see FIGS. 8 to 10) into the terminal 100. As illustrated in FIGS. 1 to 7, the terminal 100 is inserted into a terminal storage space 51 formed in an electrically insulative housing 50 from a rear towards a front of the housing 50, that is, in a direction indicated with an arrow X (see FIGS. 1, 2 and 4 to 6). The terminals 100 are inserted into all of the terminal storage spaces 51 in the housing 50 to thereby define a water-proof connector 200 illustrated in FIG. 14.

As illustrated in FIGS. 1 to 3 and 11 to 13, the housing 50 is formed therein with a plurality of the terminal storage spaces 51 partitioned by a partition wall 53. The terminal storage spaces 51 are arranged symmetrically about the partition wall 53 in two rows in a height-wise direction H and twelve columns in a width-wise direction W. A space 56 is formed between a peripheral wall 54 surrounding the terminal storage spaces 51, and an outer wall 55 of the housing 50. A housing (not illustrated) of a second connector to be coupled with the water-proof connector 200 is partially fit into the space 56.

The number of rows or columns of the terminal storage spaces 51 and arrangement of the same are not limited to the above-mentioned ones.

A front seal 57 is fit around the peripheral wall 54 at a proximal end of the peripheral wall 54, and a front holder 58 is fit around the peripheral wall 54 at a distal end of the peripheral wall 54. The front holder 58 is able to slide relative to the housing 50 in a length-wise direction L of the housing 50. The front holder 58 includes at a front wall 58*a* thereof a plurality of openings 58*b* each aligning with each of the terminal storage spaces 51.

A protrusion 58*c* protrudes towards a rear of the housing 50 from a rear surface of the front wall 58*a*. The protrusion 58*c* enters into and exits from a trench 59 formed at a front of the partition wall 53, as the front holder 58 slides in a length-wise direction L of the housing 50.

Figure 2:
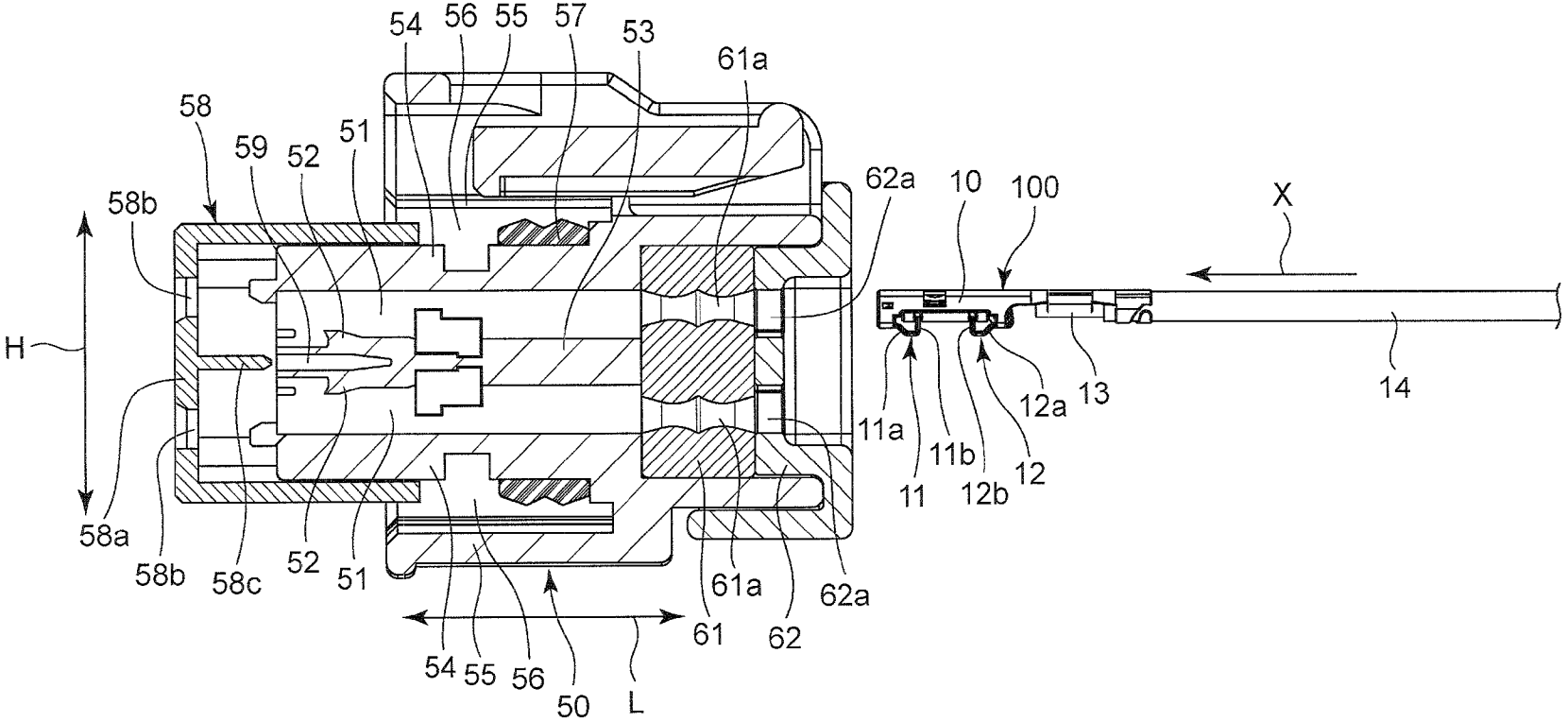
FIG. 2 is a cross-sectional view of the terminal in accordance with the preferred embodiment of the present invention and the housing before the terminal is inserted into the housing.

A retainer 60 extending in a width-wise direction W is housed in the housing 50. As illustrated in FIG. 2, the retainer 60 makes contact with opposite surfaces of the partition wall 53 in the vicinity of a later-mentioned lance 52, and occupies a part of the terminal storage space 51. As mentioned later, the retainer 60 is designed to be inserted into and released out of the housing 50 in a width-wise direction W from one of sides (for instance, a right side) towards the other side (for instance, a left side) of the housing 50.

A water-proof mat seal 61 and a mat seal cover 62 are fit into the housing 50 at the rear of the housing 50. The water-proof mat seal 61 is formed with a plurality of through-holes 61*a* each aligning with each of the terminal storage spaces 51. The mat seal cover 62 is formed with a plurality of through-holes 62*a* each aligning with both each of the through-holes 61*a* and each of the terminal storage spaces 51.

As illustrated in FIGS. 4 to 7, the terminal 100 includes a hollow sheath portion 10, a first engagement portion 11, and a second engagement portion 12.

The sheath portion 10 is situated at a distal end of the terminal 100 in a direction X in which the terminal 100 is inserted into the housing 50. The sheath portion 10 has a rectangular cross-section.

The first engagement portion 11 is engaged with a lance 52 (see FIG. 2) formed within the terminal storage space 51. The first engagement portion 11 extends outwardly from the sheath portion 10, and is situated in the vicinity of a distal end of the sheath portion 10.

The second engagement portion 12 is located remotely from the first engagement portion 11 in a length-wise direction X of the terminal 100, and extends outwardly from the sheath portion 10 similarly to the first engagement portion 11. The second engagement portion 12 makes contact with a part of an inner surface of the terminal storage space 51.

The first engagement portion 11 includes a first inclining portion 11*a* having such an inclination angle that a part thereof located closer to a rear end (a right end in FIG. 4) of the terminal 100 is remoter from an axis 10*c* of the sheath portion 10. The first engagement portion 11 also includes a first abutment portion 11*b* extending from a top end of the first inclining portion 11*a* towards the axis 10*c* of the sheath portion 10 and making abutment at a lower end thereof with a ceiling 10*a* of the sheath portion 10. The first abutment portion 11*b* is in the form of a flat sheet.

The second engagement portion 12 includes a second inclining portion 12*a* having such an inclination angle that a part thereof located closer to the rear end of the terminal 100 is closer to the axis 10*c* of the sheath portion 10. The second engagement portion 12 also includes a second abutment portion 12*b* extending from a top end of the second inclining portion 12*a* towards the axis 10*c* of the sheath portion 10, and making abutment at a lower end thereof with the ceiling 10*a* of the sheath portion 10. The second abutment portion 12*b* is in the form of a flat sheet.

The terminal 100 further includes a first reinforcement 21 for preventing the first engagement portion 11 from being displaced and/or deformed due to an external force acting thereon in parallel with the direction X. The first reinforcement 21 is situated on the ceiling 10*a* of the sheath portion 10, and makes contact with a lower end of the first abutment portion 11*b*.

The terminal 100 further includes a second reinforcement 22 for preventing the first engagement portion 11 from being displaced and/or deformed due to an external force acting thereon in parallel with the direction X. The second reinforcement 22 is situated on the ceiling 10*a* of the sheath portion 10, and makes contact with a lower end of the first abutment portion 11*b*. Specifically, the first reinforcement 21 and the second reinforcement 22 sandwich the first abutment portion 11*b* at a lower end of the first abutment portion 11*b*.

The terminal 100 further includes a third reinforcement 23 for preventing the second engagement portion 12 from being displaced and/or deformed due to an external force acting thereon in parallel with the direction X. The third reinforcement 23 is situated on the ceiling 10*a* of the sheath portion 10, and makes contact with a lower end of the second abutment portion 12*b*. Specifically, the first reinforcement 21 and the third reinforcement 23 sandwich the second abutment portion 12*b* at a lower end of the second abutment portion 12*b*.

Each of the first to third reinforcements 21, 22 and 23 is in the form of a flat sheet so as to make plane-contact with an outer surface of the ceiling 10*a* of the sheath portion 10.

The terminal 100 further includes a core-fixing section 13 remote from the second engagement portion 12. Core wires (not illustrated) exposed out of an electrically insulating outer cover of a cable 14 through which electrical signals are transmitted are compressed onto and fixed in the core-fixing section 13, and thus, the cable 14 and the terminal 100 are electrically connected to each other.

Figure 8:
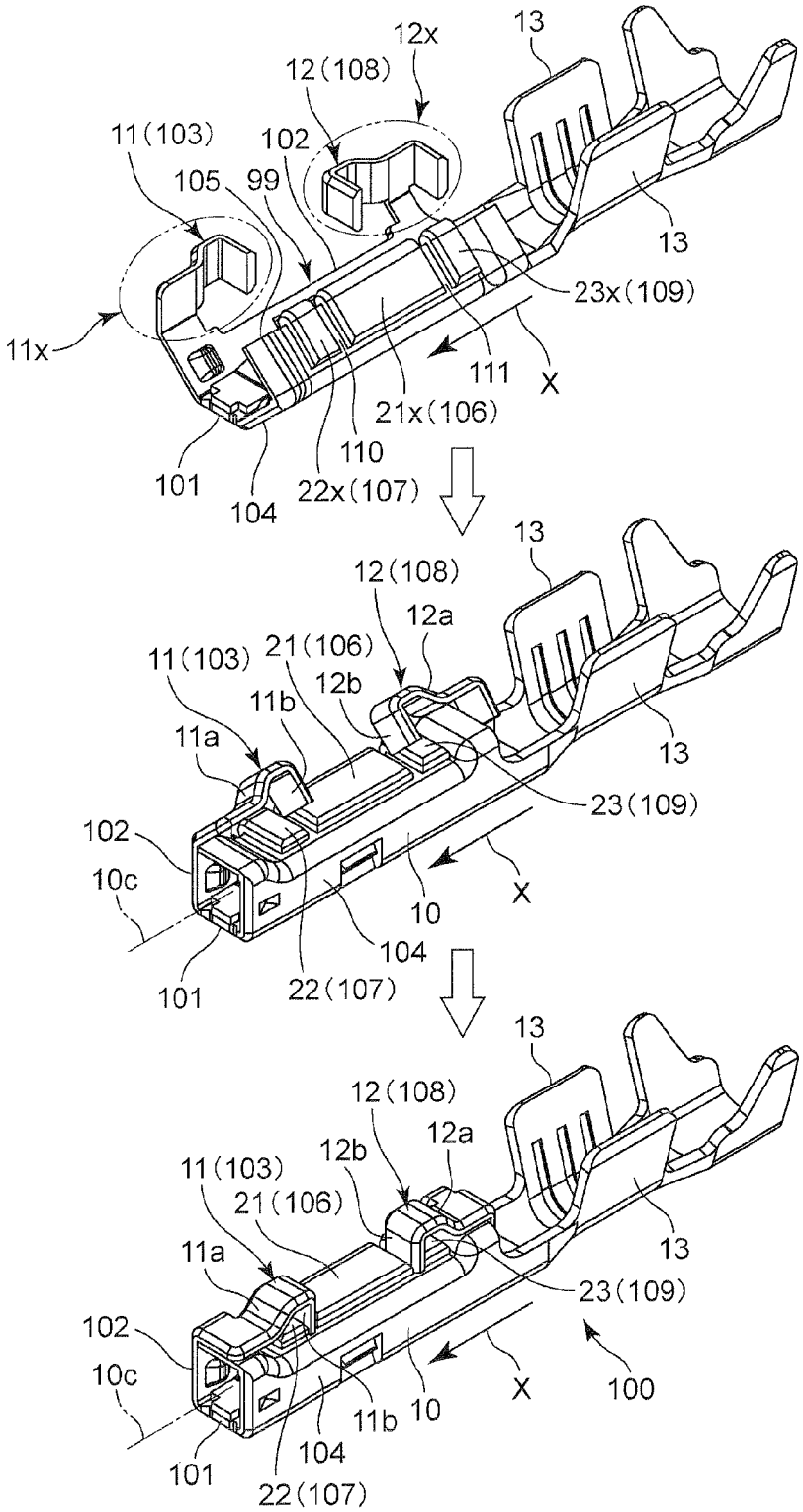
FIG. 8 is a perspective view illustrating steps of fabricating the terminal.
Figure 9:
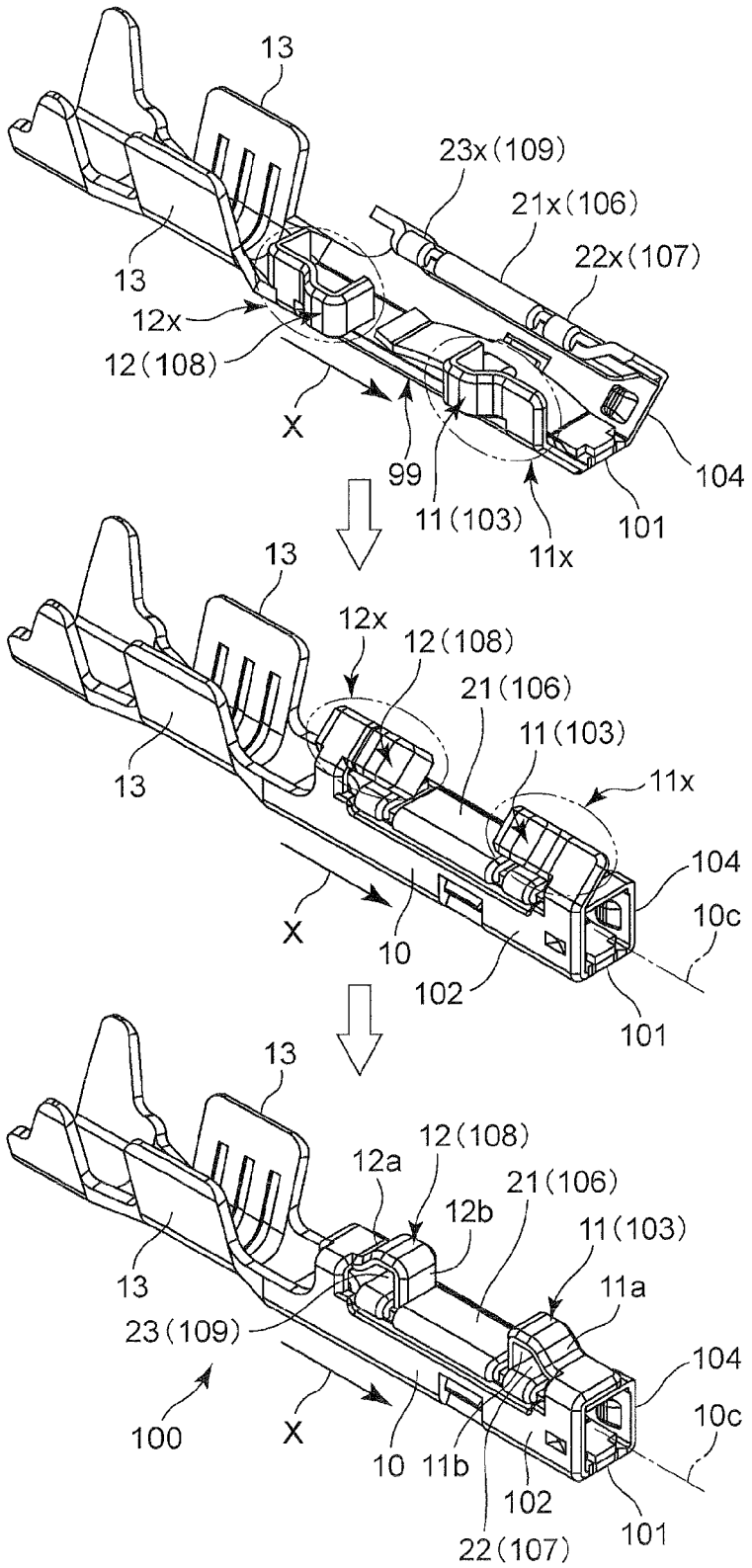
FIG. 9 is a perspective view illustrating steps of fabricating the terminal.
Figure 10:
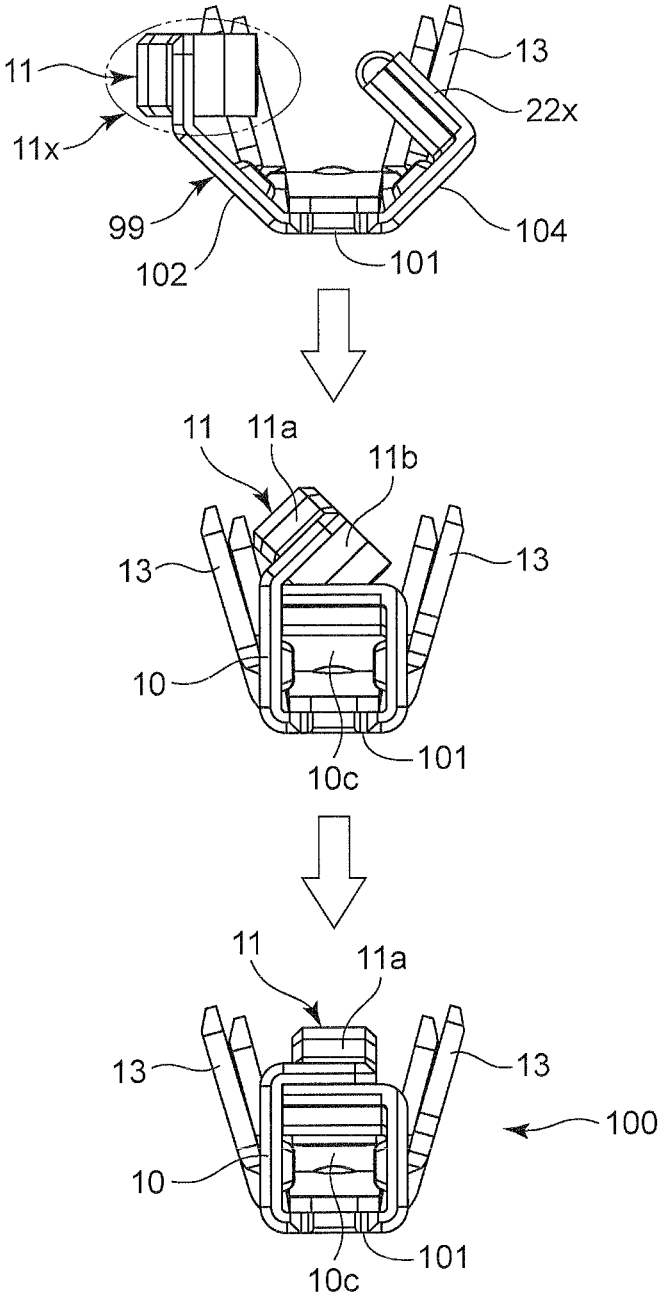
FIG. 10 is a front view illustrating steps of fabricating the terminal.
Figure 11:
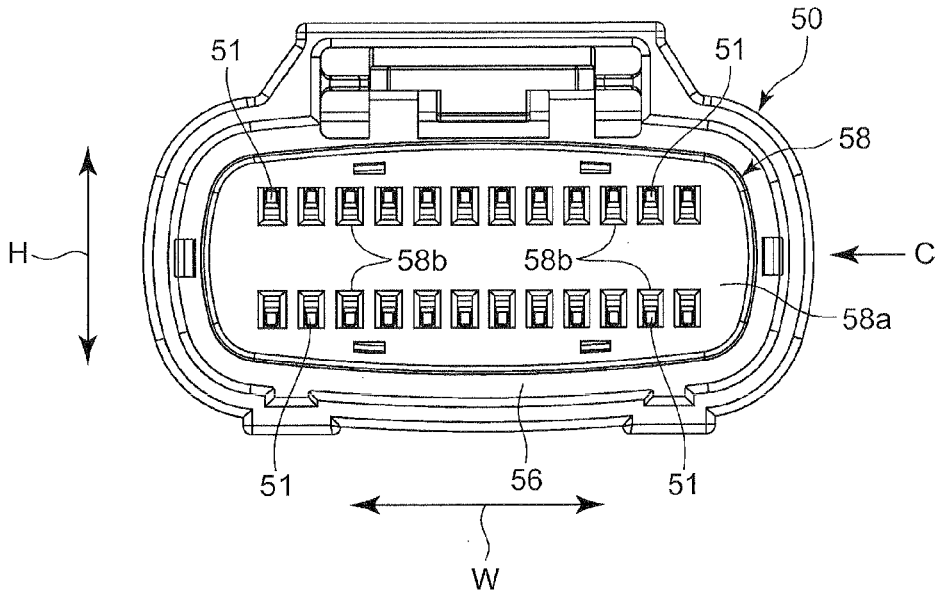
FIG. 11 is a front view of the housing illustrated in FIG. 1.
Figure 12:
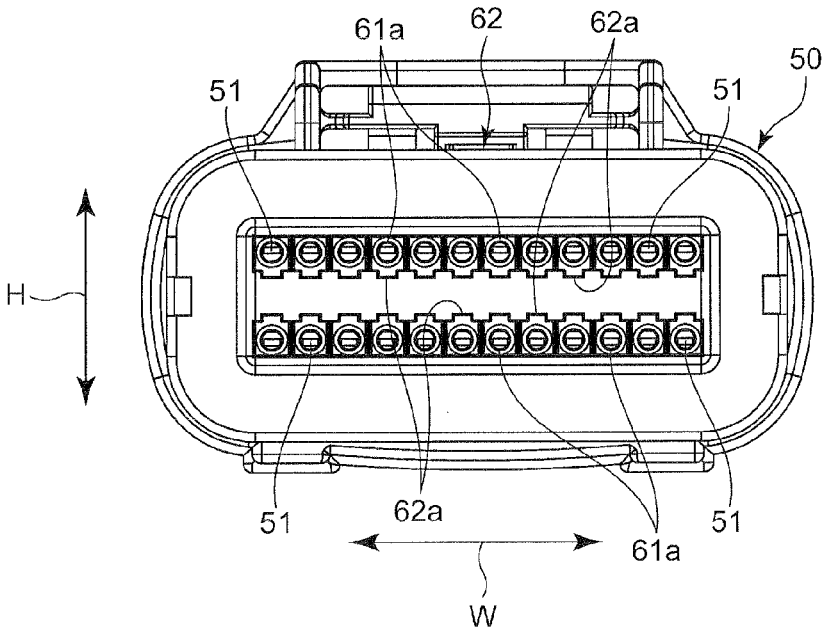
FIG. 12 is a rear view of the housing illustrated in FIG. 1.

As illustrated in FIGS. 8, 9 and 10, the first engagement portion 11 of the terminal 100 is formed by bending a projecting part 11*x* about a direction intersecting with the axis 10*c* of the sheath portion 10. The projecting part 11*x* is a part of the metal sheet 99 defining the sheath portion 10, and extending in parallel with the direction X.

Similarly to the first engagement portion 11, as illustrated in FIGS. 8, 9 and 10, the second engagement portion 12 of the terminal 100 is formed by bending a projecting part 12*x* about a direction in parallel with the axis 10*c* of the sheath portion 10. The projecting part 12*x* is a part of the metal sheet 99 defining the sheath portion 10, and extending in parallel with the direction X.

The first, second and third reinforcements 21, 22 and 23 are formed by bending a first projecting part 21*x*, a second projecting part 22*x*, and a third projecting part 23*x* around a direction in parallel with the direction X, respectively. Each of the first to third projecting parts 21*x*, 22*x* and 23*x* is a part of the metal sheet 99 defining the sheath portion 10, and extending in a direction intersecting with the axis 10*c* of the sheath portion 10.

Hereinbelow is explained a process of assembling the water-proof connector 200, with reference to FIGS. 1 to 3 and 12 to 17.

First, as illustrated in FIGS. 1 and 2, the terminal 100 is inserted into the housing 50 from the rear towards the front of the housing 50 under the condition that the front holder 58 is kept pulled from the housing 50. Specifically, the terminal 100 is inserted first into the through-hole 62*a* of the mat seal cover 62, and then, further inserted in the direction X. Thus, the sheath portion 10 of the terminal 100 passes through the through-holes 62*a* of the mat seal cover 62 and the through-holes 61*a* of the water-proof mat seal 61, and is housed in the terminal storage space 51. When the terminal 100 is in the terminal storage space 51, the lance 52 of the housing 50 is fit into a recess formed between the first and second engagement portions 11 and 12.

Figure 16:
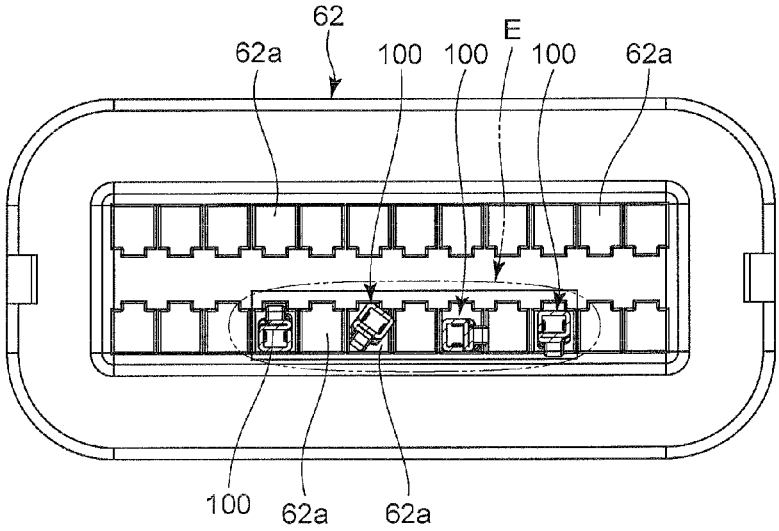
FIG. 16 is a partial cross-sectional view taken along the line D-D shown in FIG. 15.
Figure 17:
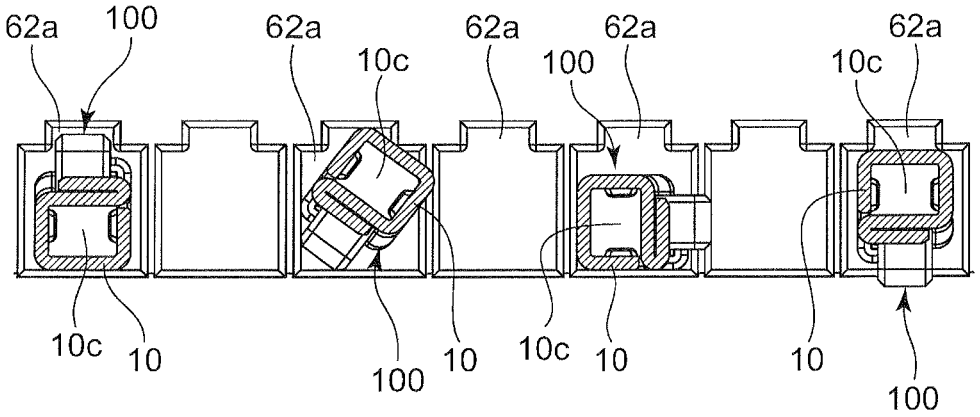
FIG. 17 is an enlarged view of a portion indicated with an arrow E shown in FIG. 16.
Figure 18:
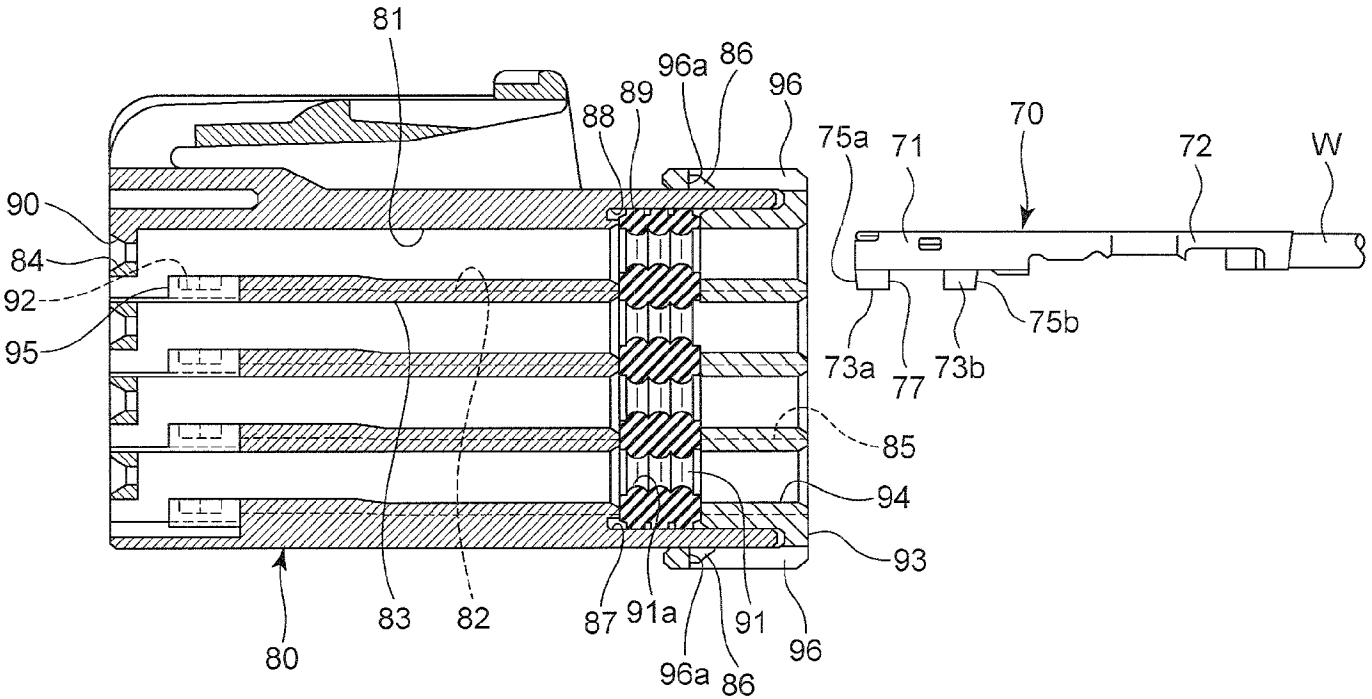
FIG. 18 is a broken cross-sectional view of a conventional terminal and a connector housing.
Figure 19:
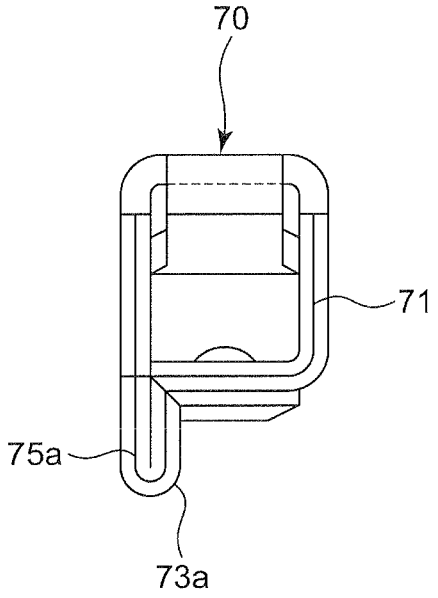
FIG. 19 is a front view of the terminal illustrated in FIG. 18.

Since the first engagement portion 11 outwardly projects from the sheath portion 10 having a rectangular cross-section, as illustrated in FIGS. 16 and 17, the terminal 100 has a shape of a combination of a rectangle and a projection when viewed from front. The through-holes 62*a* of the mat seal cover 62 are designed to have a cross-sectional shape analogous to and slightly larger than the horizontally viewed shape of the terminal 100. Thus, the terminal 100 cannot be inserted into the through-hole 62*a* if the terminal 100 is inserted into the through-hole 62*a* in such a posture that the terminal 100 is circumferentially deviated around the axis 10*c* of the sheath portion 10, like the three terminals 100 among the four terminals 100 illustrated in FIGS. 16 and 17 except for the leftmost terminal. Accordingly, it is possible to prevent the terminal 100 from being inserted into the through-hole 62*a* in a defective posture.

After the terminals 100 are inserted into all of the terminal storage spaces 51 of the housing 50 in accordance with the above-mentioned steps, the front holder 58 is pushed towards the rear of the housing 50. Since the protrusion 58*c* of the front holder 58 is inserted into the trench 59 formed at the partition wall 53, the lance 52 is kept engaged with the sheath portion 10 of the terminal 100. If any one of the terminals 100 is in a defective posture as the terminals 100 illustrated in FIG. 17 except for the leftmost one, the lance 52 is kept deformed to protrude into the trench 59 by means of the first engagement portion 11, and accordingly, the front holder 58 cannot be fully pushed, and thus, the front holder 58 cannot be engaged with the housing 50. As a result, it enables to detect the terminal 100 in a defective posture.

Figure 3:
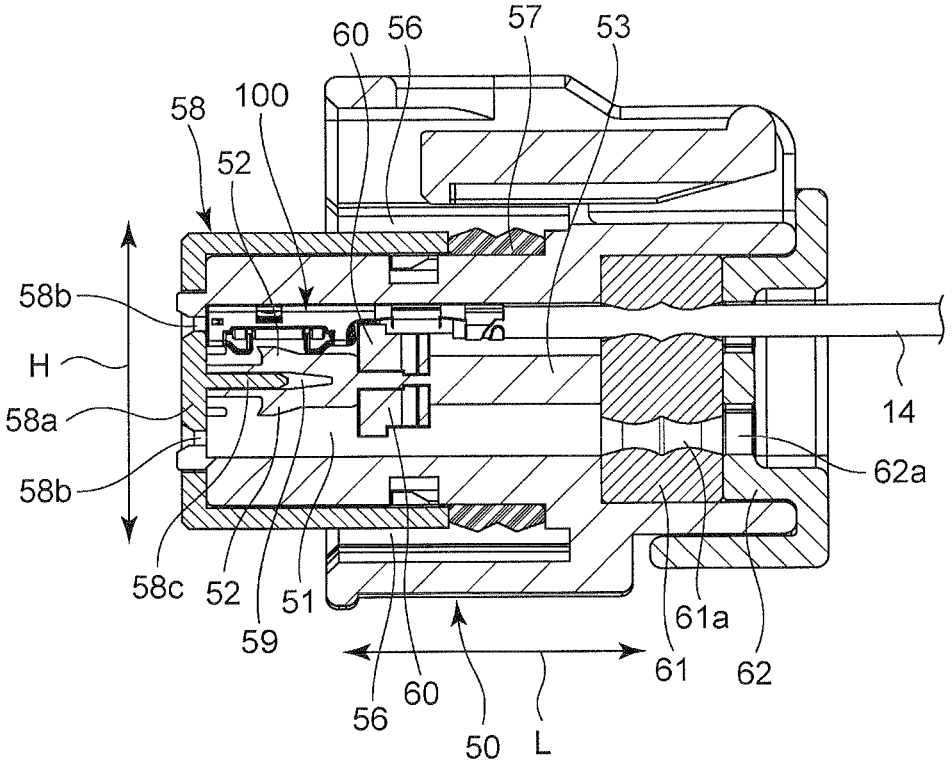
FIG. 3 is a cross-sectional view of the terminal in accordance with a preferred embodiment of the present invention and the housing after the terminal is inserted into the housing.
Figure 4:
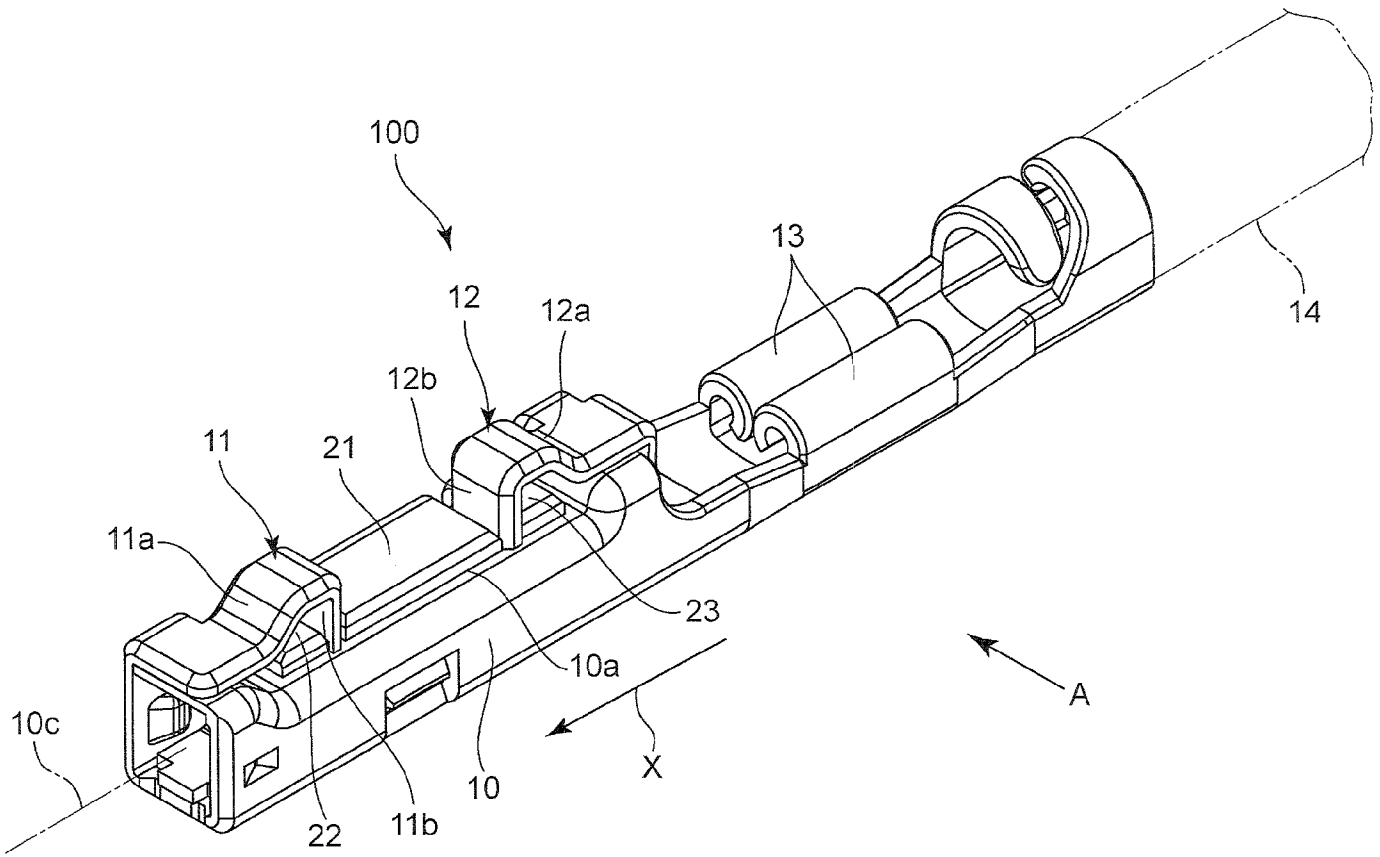
FIG. 4 is a perspective view of the terminal illustrated in FIG. 1.
Figure 5:
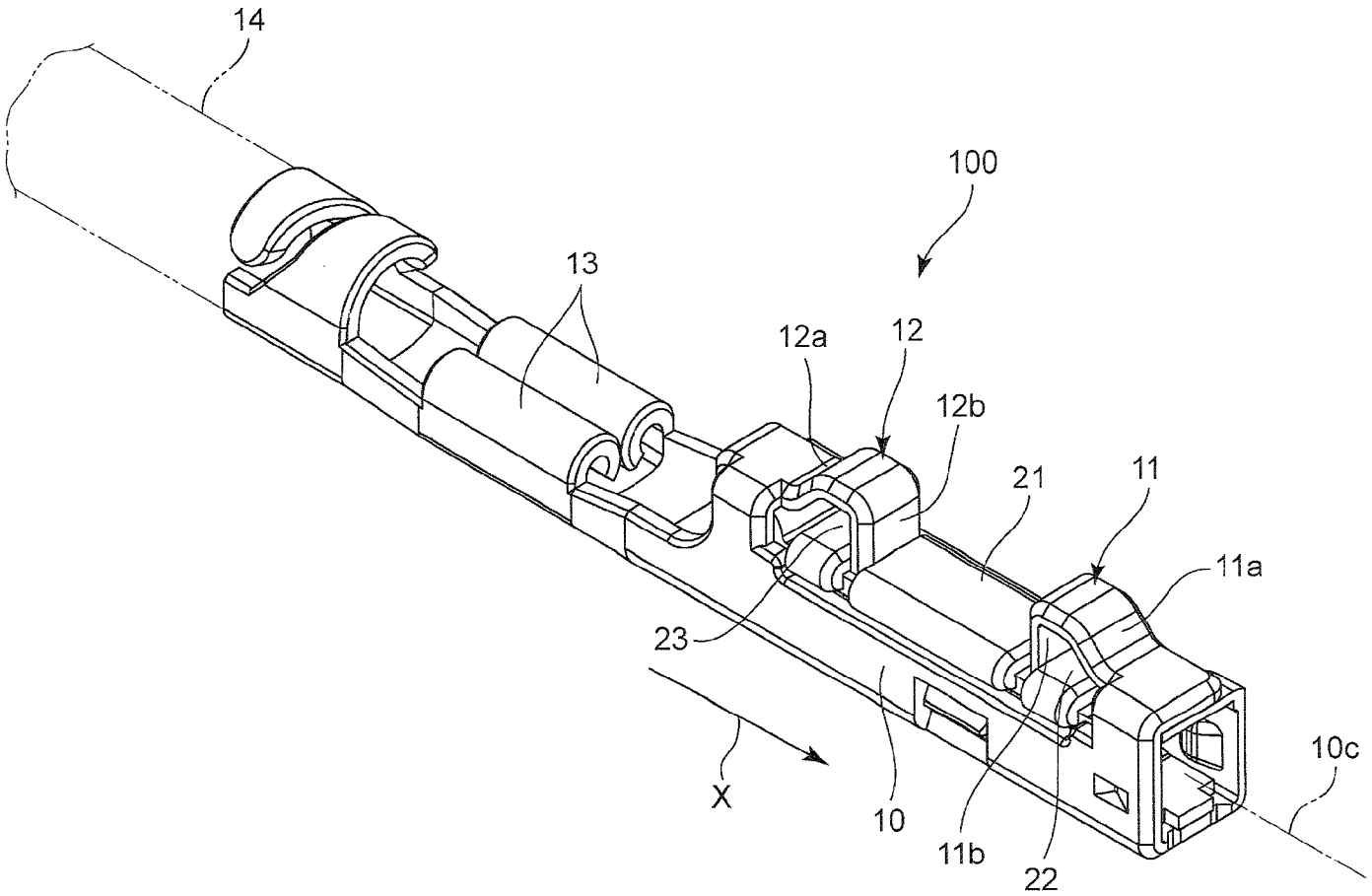
FIG. 5 is a perspective view of the terminal illustrated in FIG. 1.
Figure 6:
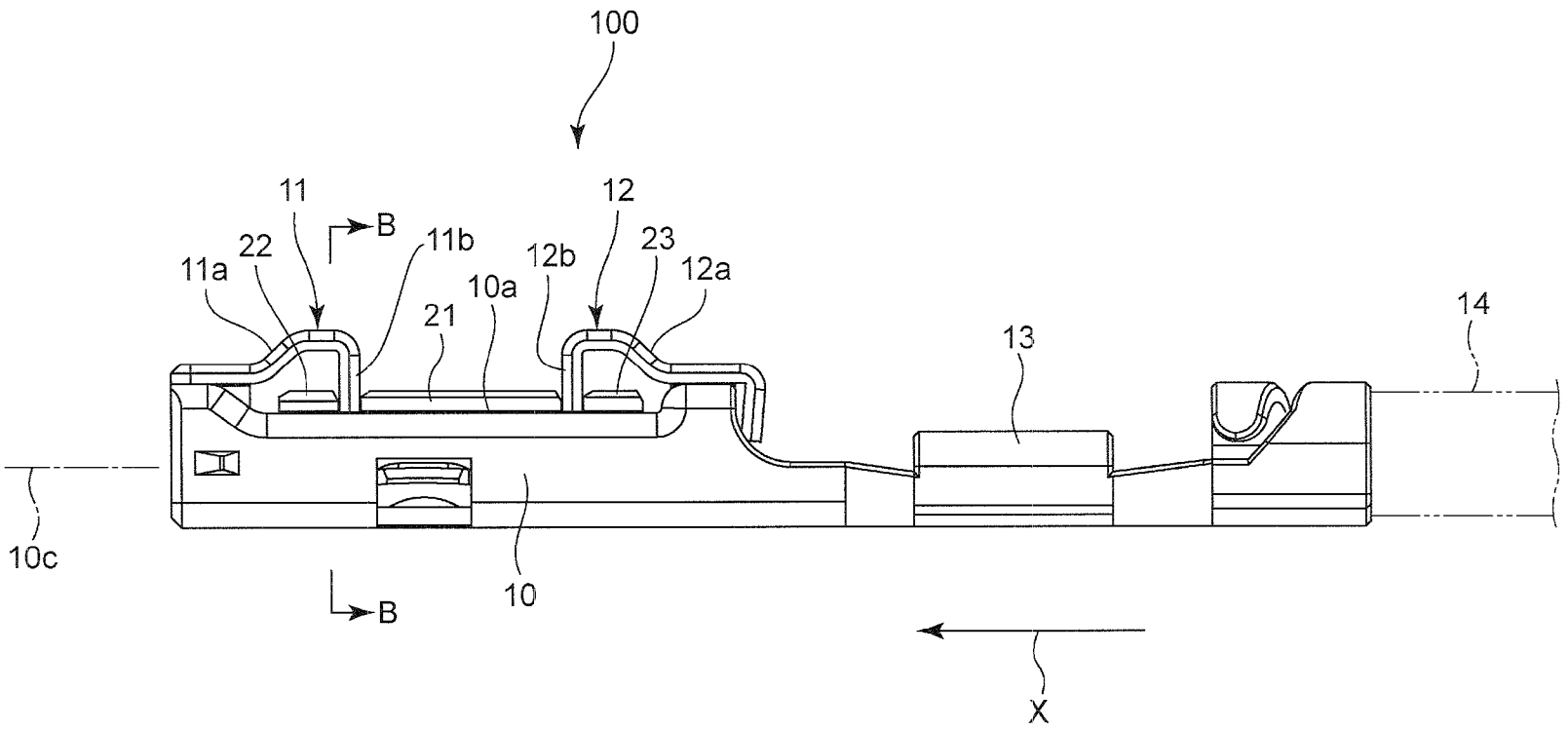
FIG. 6 is a side view of the terminal viewed in a direction indicated with an arrow A shown in FIG. 4.
Figure 7:
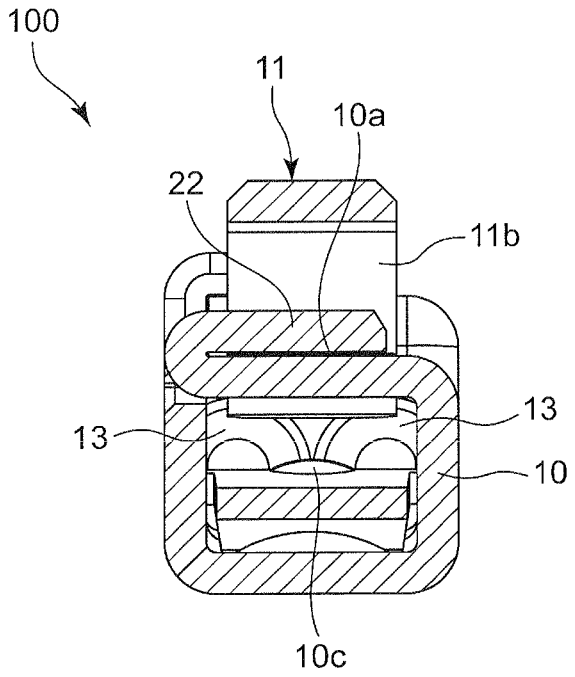
FIG. 7 is a cross-sectional view taken along the line B-B shown in FIG. 6.
Figure 13:
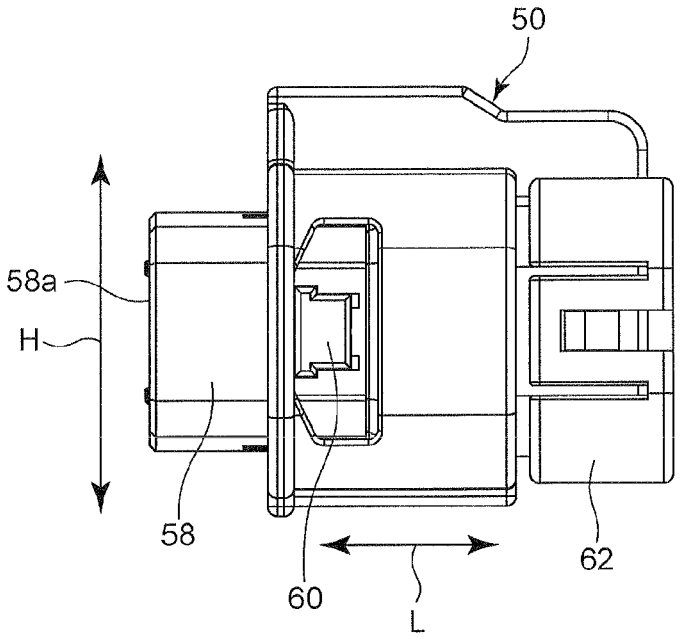
FIG. 13 is a side view of the housing viewed in a direction indicated with an arrow C shown in FIG. 11.
Figure 14:
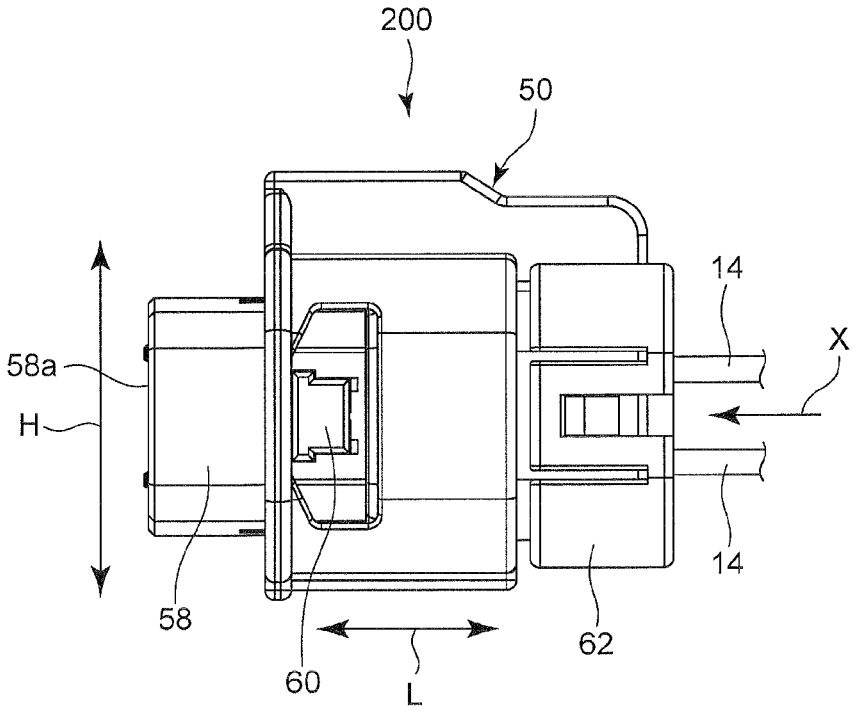
FIG. 14 is a side view of a water-proof connector including the terminal in accordance with the preferred embodiment of the present invention, and the housing into which the terminal is inserted.
Figure 15:
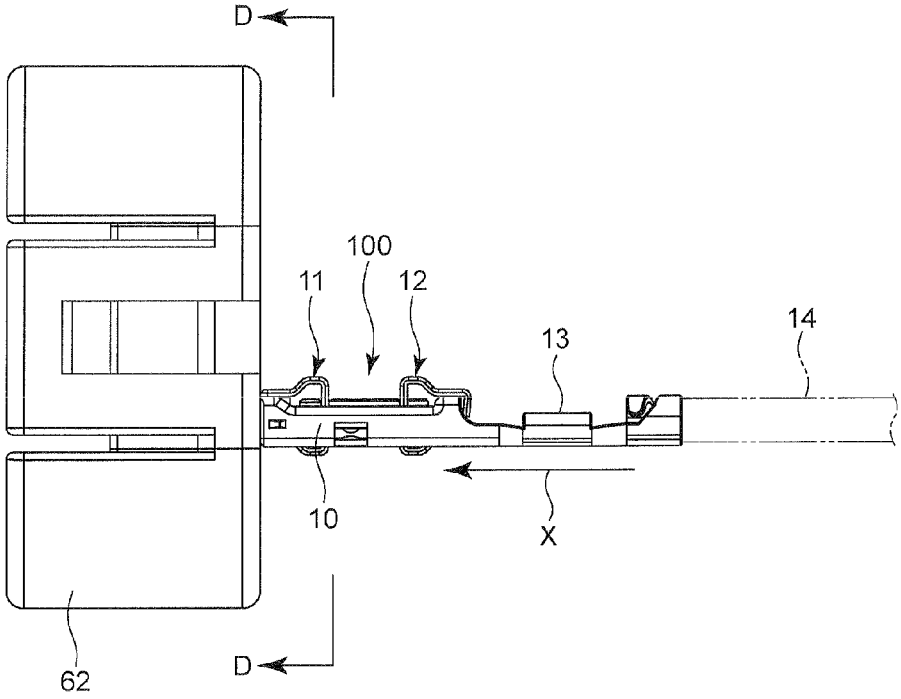
FIG. 15 is a side view illustrating that the terminal illustrated in FIG. 1 is about to be inserted into a cover of the housing illustrated in FIG. 13.

After the front holder 58 is pushed to a predetermined position, the retainer 60 is inserted into the housing 50 through a right side towards a left side of the housing 50, as illustrated in FIG. 13. Thus, as illustrated in FIG. 3, the retainer 60 is engaged with the terminals 100 in the housing 50. Thus, there is completed the water-proof connector 200 illustrated in FIG. 14.

If any one of the terminals 100 is in a defective posture as the terminals 100 illustrated in FIG. 17 except for the leftmost one, the retainer 60 makes abutment at its distal end with the sheath portion 10 or the second engagement portion 12, and hence, cannot be inserted into a predetermined position in the housing 50. Thus, it is possible to detect that any one of the terminals 100 is inserted into the housing 50 in a defective posture.

The first engagement portion 11 in the terminal 100 in accordance with the current embodiment is designed to include the first inclining portion 11*a* having such an inclination angle that a part thereof located closer to the rear end (the right end in FIG. 4) of the terminal 100 is remoter from the axis 10*c* of the sheath portion 10, that is, the first inclining portion 11*a* sloping upward to a rear end of the terminal 100. Thus, when the terminal 100 is inserted into the terminal storage space 51 through both the through-hole 62*a* of the mat seal cover 62 and the through-hole 61*a* of the water-proof mat seal 61, the first inclining portion 11*a* acts as a wedge, and accordingly, the terminal 100 can be smoothly and readily inserted into the housing 50, and further, it is possible to prevent the water-proof mat seal 61 from being damaged by the terminal 100.

Furthermore, the first engagement portion 11 is designed to include the first inclining portion 11*a*, and the first abutment portion 11*b* extending from the top end of the first inclining portion 11*a* towards the axis 10*c* of the sheath portion 10, and making abutment at a lower end thereof with the ceiling 10*a* of the sheath portion 10. The first engagement portion 11 is formed by bending the projecting part 11*x* about a direction intersecting with the axis 10*c* of the sheath portion 10. Herein, the projecting part 11*x* is a part of the metal sheet 99 defining the sheath portion 10, and extending in parallel with the direction X. Thus, the sheath portion 10 and the first engagement portion 11 are integral with each other to thereby have an increased rigidity, which prevents deformation of the first engagement portion 11 even if an external force acts in the direction X on the terminal 100 having been inserted into the terminal storage space 51 in the housing 50.

Similarly to the first engagement portion 11, the second engagement portion 12 is designed to include the second inclining portion 12*a*, and the second abutment portion 12*b* extending from the top end of the second inclining portion 12*a* towards the axis 10*c* of the sheath portion 10, and making abutment at a lower end thereof with the ceiling 10*a* of the sheath portion 10. The second engagement portion 12 is formed by bending the projecting part 12*x* about a direction intersecting with the axis 10*c* of the sheath portion 10. The projecting part 12*x* is a part of the metal sheet 99 defining the sheath portion 10, and extending in parallel with the direction X. Thus, the sheath portion 10 and the second engagement portion 12 are integral with each other to thereby have an increased rigidity, which prevents deformation of the second engagement portion 12 even if an external force acts in the direction X on the terminal 100 having been inserted into the terminal storage space 51 in the housing 50.

Furthermore, the first and second engagement portions 11 and 12 prevent the terminal 100 from upward and downward oscillation (movement in a direction perpendicular to the direction X) in the housing 50.

In the terminal 100, the first abutment portion 11*b* of the first engagement portion 11 is sandwiched at a lower end thereof between the first reinforcement 21 and the second reinforcement 22, and further, the second abutment portion 12*b* of the second engagement portion 12 is sandwiched at a lower end thereof between the first reinforcement 21 and the third reinforcement 23. This effectively prevents the first and second engagement portions 11 and 12 from being displaced and deformed due to an external force acting on the terminal 100 in the direction X.

As illustrated in FIGS. 8 and 9, the first reinforcement 21, the second reinforcement 22 and the third reinforcement 23 can be formed by bending the first projecting part 21*x*, the second projecting part 22*x* and the third projecting part 23*x*, respectively, around a direction in parallel with the direction X, the first to third first projecting parts 21*x*, 22*x* and 23*x* being parts of the metal sheet 99 defining the sheath portion 10, and extending in a direction intersecting with the direction X. This avoids complexity in the process of fabricating the terminal 100.

Furthermore, the first to third reinforcements 21, 22 and 23 are in the form of a flat sheet to make plane-contact with an outer surface of the ceiling 10*a* of the sheath portion 10 to act as a superior reinforcement without increasing in the size of the terminal 100.

The terminal 100 is fabricated from the single metal sheet 99, as illustrated in FIGS. 8 to 10.

The metal sheet 99 includes a first area 101 extending in the direction X to define a bottom of the sheath portion 10, a second area 102 outwardly extending from one of side edges of the first area 101 to define one of sidewalls of the sheath portion 10, a third area 103 outwardly extending from the second area 102 to define the first engagement portion 11, a fourth area 104 outwardly extending from the other side edge of the first area 101 to define the other sidewall of the sheath portion 10, a fifth area 105 outwardly extending from the fourth area 104 to define the ceiling 10*a* of the sheath portion 10, a sixth area 106 outwardly extending from the fifth area 105 to define the first reinforcement 21, a seventh area 107 outwardly extending from the fifth area 105 to define the second reinforcement 22, an eighth, area 108 outwardly extending from the second area 102 to define the second engagement portion 12, and a ninth area 109 outwardly extending from the fifth area 105 to define the third reinforcement 23.

The sixth and seventh areas 106 and 107 are located adjacent to each other through a cut-out 110 having a width to allow the first abutment portion 11*b* to be fit thereinto.

The third and eighth areas 103 and 108 are spaced away from each other in the direction X.

The sixth and ninth areas 106 and 109 are located adjacent to each other through a cut-out 111 having a width to allow the second abutment portion 12*b* to be fit thereinto.

The terminal 100 can be fabricated by bending the metal sheet 99 in such a way as illustrated in FIGS. 8 to 10.

Specifically, the second area 102 is perpendicularly bent relative to the first area 101 to thereby define one of sidewalls of the sheath portion 10. Then, the third area 103 is bent about a direction intersecting with the axis 10*c* of the sheath portion 10 to define the first engagement portion 11. Then, the fourth area 104 is bent perpendicularly relative to the first area 101 to thereby define the other sidewall of the sheath portion 10. Then, the fifth area 105 is perpendicularly bent relative to the fourth area 104 to thereby define the ceiling 10*a* of the sheath portion. Then, the sixth area 106, the seventh area 107 and the ninth area 109 are bent relative to the fifth area 105 so as to make plane-contact with the fifth area 105. Then, the eighth area 108 is bent about a direction intersecting with the axis 10*c* of the sheath portion 10 to define the second engagement portion 12.

Thus, there is completed the terminal 100.

INDUSTRIAL APPLICABILITY

The terminal in accordance with the present invention can be employed broadly in various industrial fields such as an electronic/electric device industry and an automobile industry, as a component of a water-proof connector or any analogous device to be used for electrical connection between devices.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-121698 filed on Jun. 12, 2014 including specification, claims, drawings and summary is incorporated herein by reference in its entirety.

What is claimed is:

1. A terminal to be inserted into a storage space formed in a housing, said terminal including:

a hollow sheath portion; and a first engagement portion to be engaged with a lance formed within said storage space, said first engagement portion extending outwardly from said sheath portion, said first engagement portion including:

a first inclining portion having such an inclination angle that a part thereof located closer to one of opposite ends of said terminal is remoter from an axis of said sheath portion; and a first abutment portion extending from an upper end of said first inclining portion towards said axis of said sheath portion and making abutment at a lower end thereof with a ceiling of said sheath portion, said terminal being formed of a single metal sheet, said first engagement portion being formed by bending a projecting part around a direction intersecting with said axis of said sheath portion, said projecting part being a part of said metal sheet defining said sheath portion and extending in parallel with a direction in which said terminal is inserted into said housing.

2. The terminal as set forth in claim 1, further including a first reinforcement for preventing said first engagement portion from being displaced and/or deformed due to an external force acting thereon in parallel with said direction in which said terminal is inserted into said housing, said first reinforcement being situated to make contact with said lower end of said first abutment portion.

3. The terminal as set forth in claim 2, further including a second reinforcement for preventing said first engagement portion from being displaced and/or deformed due to an external force acting thereon in parallel with a direction in which said terminal is inserted into said housing, said second reinforcement sandwiching said first abutment portion at said lower end thereof together with said first reinforcement.

4. The terminal as set forth in claim 1, further including a second engagement portion located remotely from said first engagement portion in a length-wise direction of said terminal, said second engagement portion extending outwardly from said sheath portion, said second engagement portion including:

a second inclining portion having such an inclination angle that a part thereof located closer to said one of said opposite ends of said terminal is closer to said axis of said sheath portion; and a second abutment portion extending from an upper end of said second inclining portion towards said axis of said sheath portion and making abutment at a lower end thereof with said ceiling of said sheath portion, said second engagement portion being formed by bending a projecting part around a direction intersecting with said axis of said sheath portion, said projecting part being a part of said metal sheet defining said sheath portion, and extending in parallel with said direction in which said terminal is inserted into said housing.

5. The terminal as set forth in claim 4, further including a first reinforcement for preventing said first engagement portion from being displaced and/or deformed due to an external force acting thereon in parallel with said direction in which said terminal is inserted into said housing, said first reinforcement being situated to make contact with said lower end of said first abutment portion.

6. The terminal as set forth in claim 5, further including a second reinforcement for preventing said first engagement portion from being displaced and/or deformed due to an external force acting thereon in parallel with said direction in which said terminal is inserted into said housing, said second reinforcement sandwiching said first abutment portion at said lower end thereof together with said first reinforcement.

7. The terminal as set forth in claim 2, wherein said first reinforcement is formed by bending a first projecting part around a direction in parallel with said direction in which said terminal is inserted into said housing, said first projecting part being a part of said metal sheet defining said sheath portion, and extending in a direction intersecting with said axis of said sheath portion.

8. The terminal as set forth in claim 3, wherein said second reinforcement is formed by bending a second projecting part around a direction in parallel with said direction in which said terminal is inserted into said housing, said second projecting part being a part of said metal sheet defining said sheath portion, and extending in a direction intersecting with said axis of said sheath portion.

9. The terminal as set forth in claim 2, wherein said first reinforcement is in the form of a flat sheet making plane-contact with an outer surface of said sheath portion.

10. The terminal as set forth in claim 3, wherein said second reinforcement is in the form of a flat sheet making plane-contact with an outer surface of said sheath portion.

* * * * *